United States Patent [19]

Folse

[11] Patent Number: 4,861,196

[45] Date of Patent: Aug. 29, 1989

[54] OFFSHORE DRILLING/PRODUCTION PLATFORM WITH A RETRACTABLE WORK DECK

[75] Inventor: Keith A. Folse, Houston, Tex.

[73] Assignee: Conoco Inc., Ponca City, Okla.

[21] Appl. No.: 191,315

[22] Filed: May 6, 1988

[51] Int. Cl.[4] ..... E02B 17/00

[52] U.S. Cl. ..... 405/224; 182/142; 405/195

[58] Field of Search ..... 405/195, 196, 203, 204, 405/224; 182/142, 143, 144

[56] References Cited

U.S. PATENT DOCUMENTS

| | | | |
|---|---|---|---|
| 1,085,607 | 2/1914 | Haynes | 182/143 |
| 2,066,221 | 12/1936 | Payne | 182/143 X |
| 3,916,632 | 11/1975 | Thomas | 405/196 |
| 4,276,959 | 7/1981 | Barber | 405/195 X |
| 4,546,852 | 10/1985 | Martin et al. | 182/142 X |
| 4,662,784 | 5/1987 | Hipp | 405/195 X |

*Primary Examiner*—Dennis L. Taylor
*Attorney, Agent, or Firm*—Richard K. Thomson

[57] ABSTRACT

An offshore drilling/production platform equipped with a retractable work deck. A light weight work deck constructed of tubular steel with plate steel attachment plates welded thereto. A plurality of variously configured removable panels can be bolted in a configuration that can provide the work surface needed to accomplish the tasks of installing wellhead equipment, inspecting the below deck regions of the platform or performing maintenance on such portions. A plurality of removable and foldable handrail sections are installed about the periphery of the configured work surface. The work deck can be retracted to a position immediately adjacent the lowermost fixed deck to protect it from wind and waves when not in use.

12 Claims, 4 Drawing Sheets

OFFSHORE DRILLING/PRODUCTION PLATFORM WITH A RETRACTABLE WORK DECK

The present invention is directed to an offshore drilling and/or production platform for use in the recovery of hydrocarbons. More particularly, the present invention is directed to such a platform with a retractable work deck positioned below the lowermost fixed platform deck to facilitate installation of subsea wellhead equipment, inspection of below deck apparatus, etc..

While drilling and production platforms are subject to design variations, most such platforms, be they fixed or floating, have a lower fixed deck that typically supports the well head equipment (e.g., Christmas tree valving, etc.). It is desirable at times to have a work deck positioned below this lower deck in a region that may be subjected to wave action during high seas (i.e., during a storm) to permit access to the riser or other wellhead equipment to be installed, to facilitate utilization of a wireline or other tool, and/or to inspect the below deck structure for corrosion and perform maintenance as necessary on the lower regions of these platforms.

One way such a working deck is currently provided is through the use of temporary scaffolding. Such a temporary installation does provide a structurally inexpensive solution but this solution is risky from a safety standpoint in that the support surface is being constructed while it is supporting the workers who are building it and is labor intensive in that the entire support must be constructed and torn down for each prospective usage and/or change in weather. Further, because the scaffolding is temporary, it is typically structurally skimpy and incapable of supporting significant loads safely.

Another alternative is to simply construct an additional fixed deck below the wellhead deck. Since this deck will be subject to buffeting by high seas in stormy weather, this lower deck structure must be reinforced with substantial structural supports to withstand the force of the storm. Hence, there is a significant penalty to be paid with this solution, in both weight of the work deck and in its cost.

The present invention proposes a solution to avoid the above noted problems. A retractable work deck is supported below the lower most fixed deck of the platform by hydraulic cylinders, or the like. The retractable deck is constructed of a tubular steel frame for maximum strength and minimum weight. Removable deck panels are bolted in place to permit the work deck surface to be configured in accordance with o the specific requirements of the job to be performed. Removable and foldable (i.e., collapsible) handrails are provided around the entire deck region while workers are operating on the work deck, but can be readily removed to permit the work deck to be retracted to its stored position out of the region subjected to buffeting by high sea wave action. In this manner, the retractable deck can be constructed with sufficient structural strength to withstand the loads it is required to handle (weight of tools, etc.) but need suffer no weight penalty that would otherwise be necessary to reinforce against wave damage.

The retractable work deck of the present invention also includes sway-restricting supports fixed along each side of the retractable deck to limit the amount of work platform movement induced by wind or fixed platform movement. Guide rods attached to either the fixed or movable deck are received in guide sleeves which are secured to the other of said decks. Rails are positioned both on and above the retractable deck to provide a conveyance system for dollies and trolleys that receive the running tool/guideframe assembly (or another such tool) and facilitate its movement from one work station (or well bay) to the next.

Other features, advantages and characteristics of the present invention will become apparent after a reading of the following detailed description thereof.

DETAILED DESCRIPTION OF THE PREFERRED EMBODIMENTS

Figure 1:
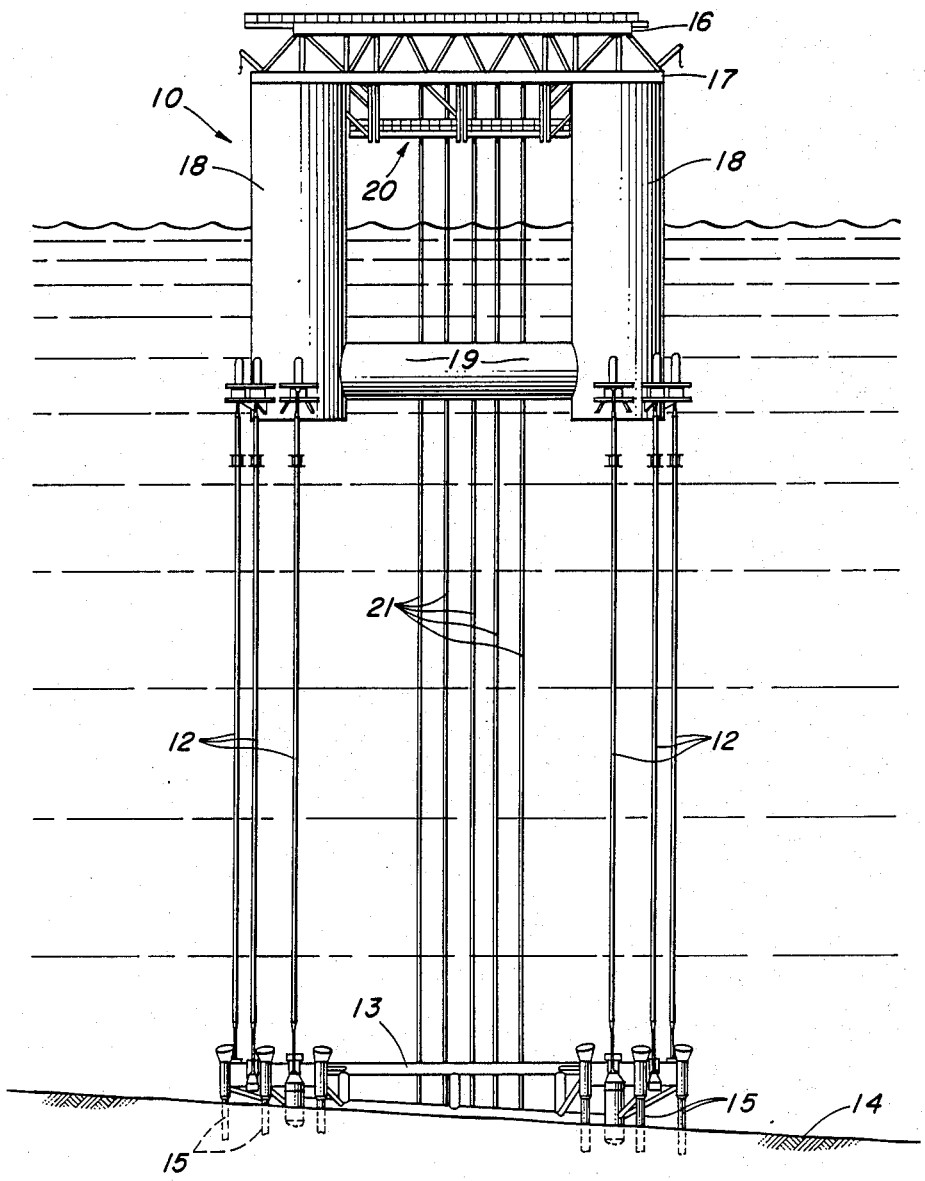
FIG. 1 is a elevational side view of a drilling platform of the present invention.

The offshore platform of the present invention is depicted in FIG. 1 generally at 10. In this preferred embodiment, the platform 10 is depicted as a tension leg platform of the type disclosed in copending U.S. patent application Ser. No. 105,942, filed Oct. 6, 1987 which is hereby incorporated by reference. It will, however, be appreciated that the inventive concepts disclosed herein might be equally well embodied in other floating platforms and, even in fixed offshore platforms, as well.

As shown in FIG. 1, platform 10 is moored in position by a plurality of tendons 12 anchoring the platform to a foundation template 13 which is secured in position on the ocean floor 14 by piles 15. Platform 10 has a first upper fixed deck 16 and a second lowermost fixed deck 17. A plurality of cornerpost columns 18 and interconnecting pontoons 19 comprise buoyancy members for maintaining tendons 12 in tension. A retractable work deck 20 is shown in its lowermost work position in FIG. 1. A plurality of risers 21 extend between the wells drilled in the ocean floor 14 and the wellhead equipment on lowermost fixed deck 17.

Figure 2:
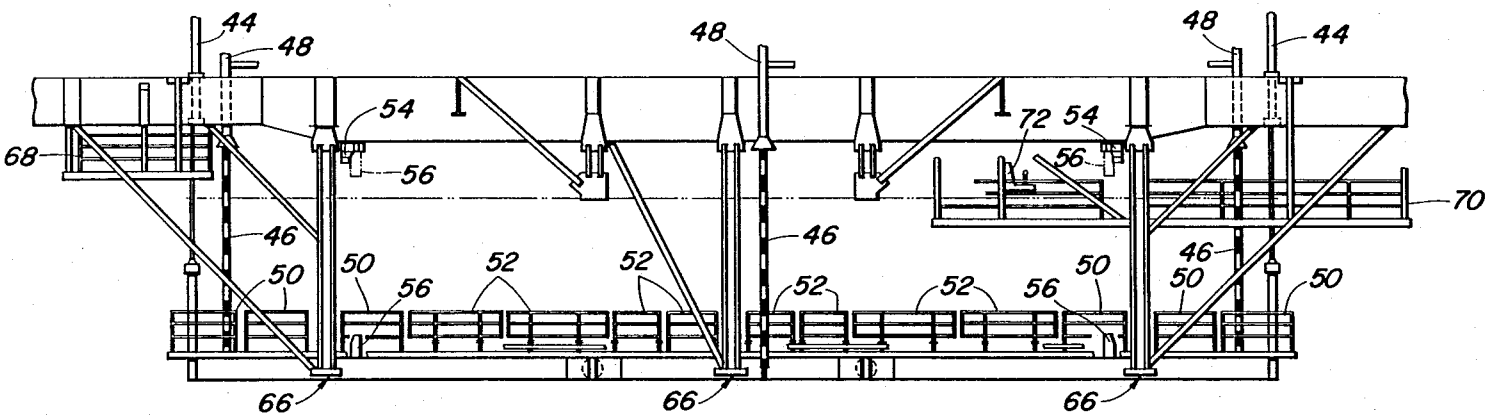
FIG. 2 is an elevational side view showing in greater detail the retractable work deck and associated structure of the present invention.
Figure 3:
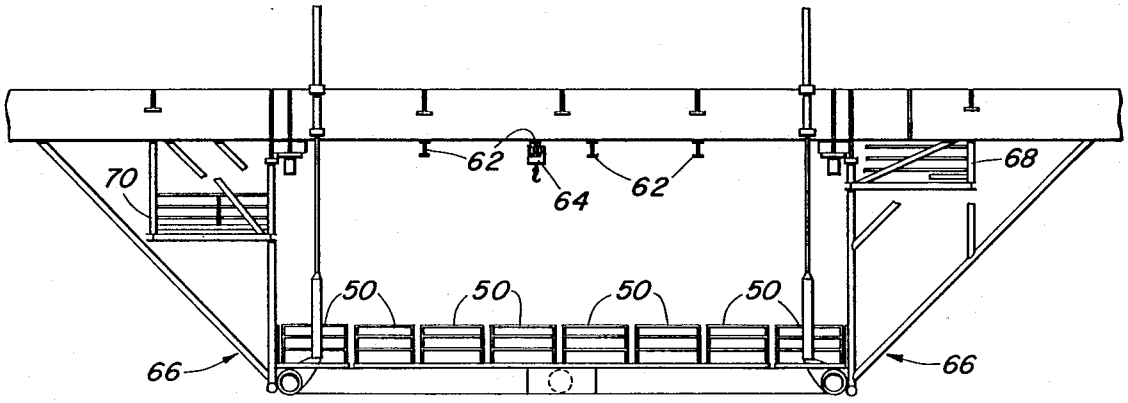
FIG. 3 is an elevational end view of the retractable work deck and associated structure shown in FIG. 2.
Figure 4:
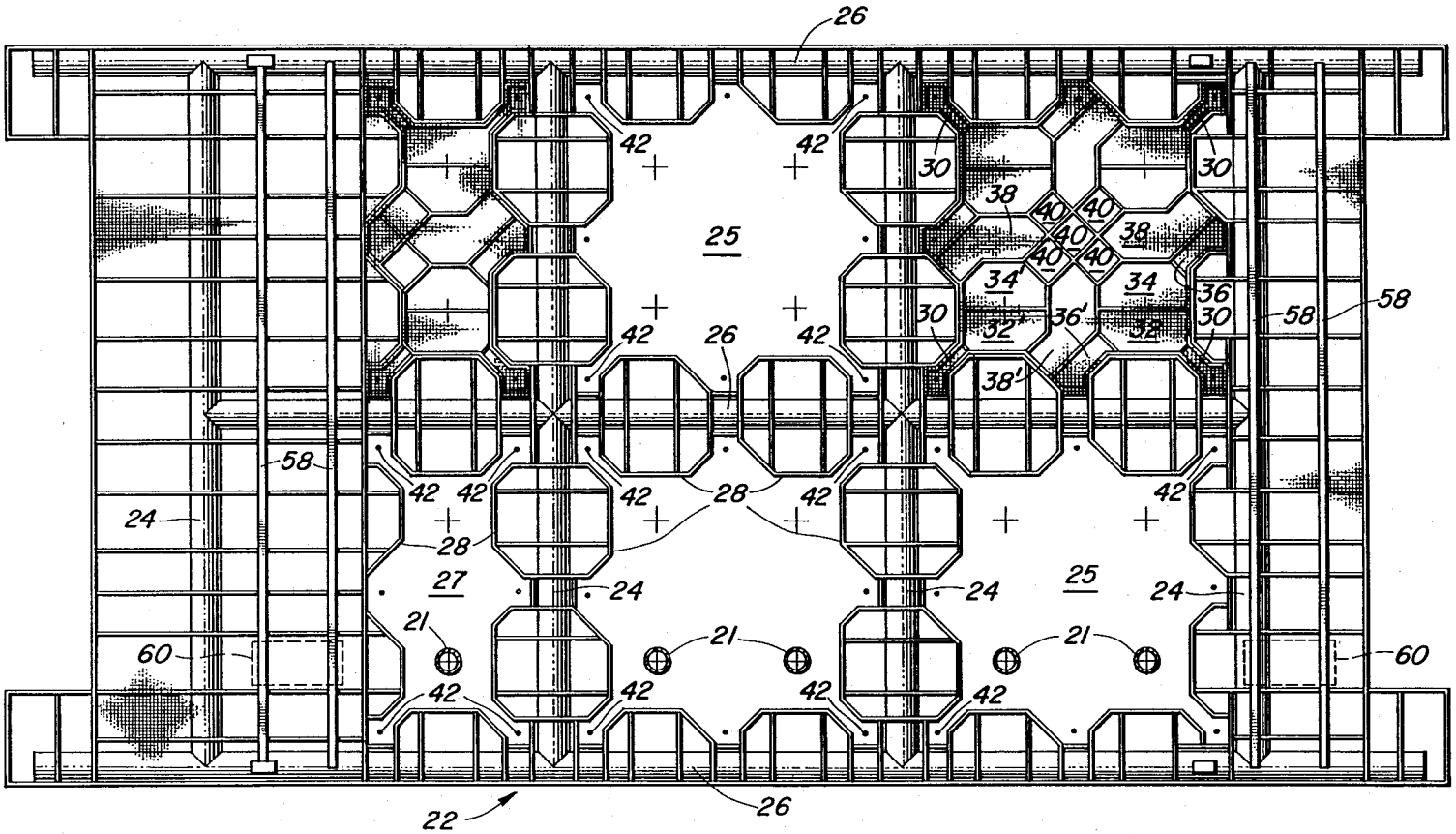
FIG. 4 is a top view of the retractable work deck of FIG. 2.

As shown in greater detail in FIGS. 2–4, work deck 20 is constructed as a tubular steel frame shown generally at 22 from lateral elements 24 and longitudinal elements 26 (FIG. 4). These lateral (24) and longitudinal (26) elements define a plurality of four well bay openings 25 and a pair of two well bay openings 27. A plurality of attachment plates 28 are secured to the lateral (24) and longitudinal (26) elements as by welding. To these support plates 28, a plurality of removable panels 30, 32, 34, 36, 38 and 40 are attached by bolts (not shown). In the preferred embodiment, panels 32, 34, 36, and 38 may be flipped over to provide the opposite hand panel for use in the adjacent well bay to eliminate the need for additional parts inventory. Alternatively, panels 32', 34', 36' and 38' of opposite hand to the corresponding unprimed referenced panel can be used in the adjacent well bay. The panels 30, 32, 34, 36, 38 and 40 have channel beam support bracing (not shown) underlying them extending between and are affixed to lateral (24) and longitudinal (26) elements and bolted to attachment plates 28 as required to provide the desired structural integrity necessary to support the design load capacity. The panels 30 through 40 have edge portions which overlap one another and/or edge portions of attachment plates 28 to permit bolting in place.

Figure 6:
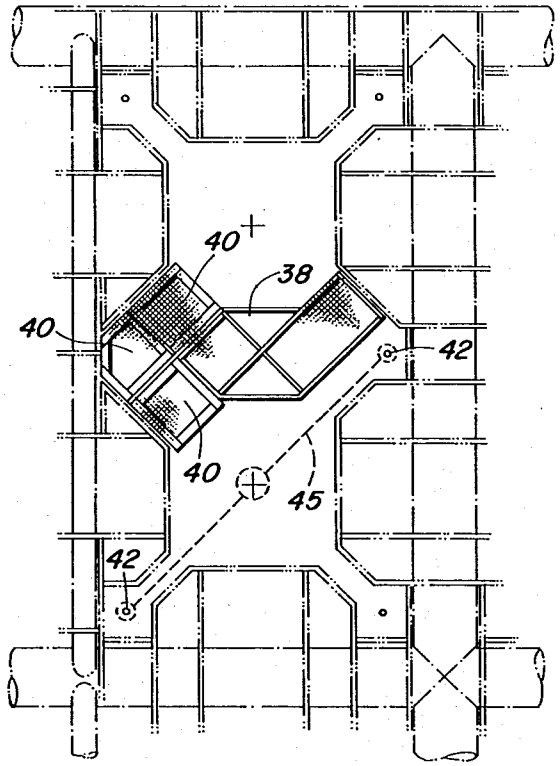
FIG. 6 is a detailed top view of a two well bay work area.
Figure 5:
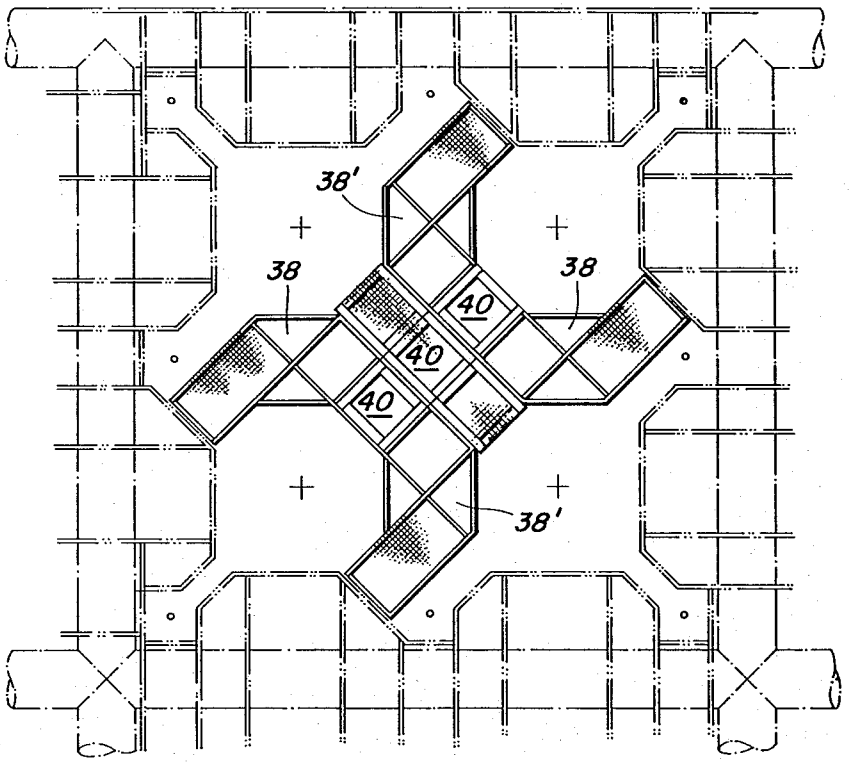
FIG. 5 is a detailed top view of a work area constructed in a four well bay platform opening.

As shown in FIG. 4, prior to any drilling activity, the entire well bay will be paneled over to provide a safe work area for personnel on the retractable work deck. As can be seen in FIG. 5 for the four well bay opening 25 and in FIG. 6 for the two well bay opening 27, the panels 30 through 40 may be selectively installed to provide access to guide wires 42 and a suitable work platform for installing riser 21 using running tool/guide frame assembly 45 or other such tools and equipment using guide wires 42. Retractable work deck 20 can also be used to inspect the below deck condition of the risers 21 and tension leg platform 10 to check for corrosion or biofouling, for example. To provide access to the other well bay guide wires 42 in the four bay (25) and two bay (27) openings, the panel configurations depicted in FIGS. 5 and 6, respectively, can be rotated 90° or some of the panels 40 can be removed with some lateral panels 36 being added to provide adequate stability. Removable handrail sections 50 will be installed around the internal periphery of the paneled work deck, regardless of its configuration as a safety precaution.

Retractable work deck 20 is suspended from the bottom of the lowermost fixed deck 17 by a plurality (four, two shown) of hydraulic lifting cylinders 44. A plurality (six, three shown) of guide rods 46 are fixedly attached to retractable deck 20 and are received in a like plurality of guide sleeves 48 that are fixedly attached to lowermost deck 27. The entire periphery of work deck 20 is bordered by safety handrails including removable handrail sections 50 positioned around the ends of work deck 20 and foldable hand rail sections 52 which extend along the sides of deck 20. With sections 50 removed and sections 52 folded down, retractable work deck 20 can be withdrawn to a position shown in dotted lines in FIG. 2. In this position a first set (four, two shown) of reaction blocks 54 extending downwardly from the bottom side of fixed deck 17 engage a like plurality of reaction blocks 56 mounted on retractable deck 20 thereby limiting its upward movement and protecting the folding handrails 52 and other deck-supported equipment from being crushed against the bottom of fixed deck 17. The hydraulic lifting cylinders 44 can typically be fixed in a plurality of work positions by inserting pins (not shown) in the portion of the hydraulic lifting cylinder 44 which extends above the cylinder housing itself. Preferably the deck 20 can be pinned in at least three work positions in addition to its stored position. Further, guide rods 46 are preferably painted with markings to make the lowering of the work deck 20 to a level, stable work position, easier.

Two sets of track rails 58 extend laterally across work deck 20 on either side of well bays 25 and 27. Tracks 58 support transfer dollies 60 to enable running tool/guide-frame assembly 45, and the like, to be transferred from one well bay to the next. I-beams 62 extend longitudinally above well bays 25 and 27 being mounted on the bottom of lower fixed deck 17. I-beams 62 form monorails which each support a trolley hoist 64 (one shown) which permit the running tool/guideframe assembly 45 to be transferred longitudinally between adjacent well bays.

Sway restricting support bracing 66 extends downwardly from the bottom of lower fixed deck 17 providing guides for deck 20 in any and all of its work positions (FIGS. 2 and 3) preventing lateral swaying of the suspended work deck 20 under influence of high winds. Also fixed to the bottom of lower fixed deck 17 are access platforms 68 and 70 positioned immediately adjacent the retractable work deck 20. Openings in lower fixed deck 17 above platforms 68 and 70 provide access to the work deck for personnel and equipment from fixed deck 17. A control panel 72 on access platform 70 provides a means for controlling the vertical positioning of retractable work deck 20 as well as operation of trolley hoists 64.

The offshore platform 10 of the present invention includes a retractable work deck 20 which provides significant flexibility in working beneath the lower fixed deck which is typically cluttered with well head valving, etc. The retractable work deck 20 has a plurality of removable support panels 30–40 that permit the deck to be configured in whatever layout best facilitates the safe performance of the job to be undertaken. The work deck can be extended to a position below lower fixed deck 17 that would be in a zone susceptible to buffeting by waves in high seas for optimizing access to below deck equipment for inspection as well as operations. After the needed work has been completed, the handrail sections can be removed or folded and the work deck 20 snugged up against the bottom of fixed deck 17 (reaction blocks 54 and 56 engaging to limit upward movement) in a position out of the susceptible zone.

Various changes, alternative and modifications to the above disclosed embodiments of the present invention will become apparent after a reading of the foregoing specification. Accordingly, it is intended all such changes, alternatives and modifications as fall within the scope of the appended claims be considered part of the present invention.

I claim:

1. A drilling platform for offshore use comprising at least one fixed deck mounted on said platform; a retractable deck mounted beneath a lowermost one of said at least one fixed deck means mounting said retractable deck for vertical movement beneath said lower most one of said at least one fixed deck, means for extending, said retractable deck to at least one working position within a region susceptible to contact by waves in high seas and retracting said retractable deck to a second storage position out of said susceptible region.

2. The drilling platform of claim 1 wherein said retractable deck further comprises a tubular frame which receives a plurality of load-supporting panels, at least some of said panels being removable.

3. The drilling platform of claim 2 further comprising handrails attached to said tubular frame and extending about the periphery of at least some of said load supporting panels, at least some of said handrails being detachable to facilitate retraction of said retractable deck to said storage position.

4. The drilling platform of claim 3 wherein some of said handrails are foldable to facilitate retraction of said retractable deck to said storage position.

5. The drilling platform of claim 1 wherein said means for retracting said retractable deck comprise a plurality of hydraulic cylinders which effect its extension and retraction.

6. The drilling platform of claim 5 wherein said means for mounting said retractable deck beneath said lowermost fixed deck further comprises a plurality of elongated guide rods fixedly attached to one of said fixed and retractable decks and a plurality of guide sleeves fixedly attached to the other of said fixed and retractable decks.

7. The drilling platform of claim 1 further comprising sway-restricting supports fixedly attached to one of said fixed and retractable platforms and engaging the other of said fixed and retractable platforms.

8. The drilling platform of claim 7 wherein said sway restricting supports extend downwardly from their fixed attachments to a bottom portion of said lowermost fixed deck.

9. The drilling platform of claim 1 further comprising a plurality of load-supporting rails mounted upon one of said fixed or retractable decks and supporting for movement a transfer dolly for permitting a guide tool, or the like, to be moved from one work station to another.

10. The drilling platform of claim 9 wherein said load supporting rails are attached to the top of said retractable platform and extend laterally to allow dolly movement and an associated tool from one work bay to an adjacent bay.

11. The drilling platform of claim 10 wherein said load-supporting rails further comprise a plurality of I-beam monorails attached to a bottom portion of said lowermost fixed deck extending longitudinally above a plurality of work bays to permit a trolley to transfer said guide tool, or the like between adjacent work bays.

12. A retractable work deck for use below the lowermost fixed deck of an offshore platform, said retractable work deck comprising (a) a tubular frame of lateral elements and longitudinal elements with attachment plates permanently affixed thereto, (b) a plurality of variously configures panels which may be removably secured to said tubular frame and said attachment plates to form a work area, (c) means to suspend said retractable work deck beneath said lowermost fixed deck in a plurality of distinct vertical positions including a retracted stored position in which said retractable work deck is immediately adjacent said lower fixed deck.

* * * * *